US006617967B2

(12) United States Patent
Baldwin et al.

(10) Patent No.: US 6,617,967 B2
(45) Date of Patent: Sep. 9, 2003

(54) PIEZOELECTRIC SIREN DRIVER CIRCUIT

(75) Inventors: Christopher Baldwin, Indianapolis, IN (US); George Burnett, Clayton, IN (US); Daniel O'Brien, Mooresville, IN (US)

(73) Assignee: Mallory Sonalert Products, Inc., Indianapolis, IN (US)

( * ) Notice: Subject to any disclaimer, the term of this patent is extended or adjusted under 35 U.S.C. 154(b) by 0 days.

(21) Appl. No.: 09/758,023

(22) Filed: Jan. 10, 2001

(65) Prior Publication Data

US 2002/0126001 A1 Sep. 12, 2002

(51) Int. Cl.[7] ..... G08B 3/10

(52) U.S. Cl. ..... 340/384.6; 340/384.1; 340/384.4; 340/384.73; 340/692; 381/150; 381/190

(58) Field of Search ..... 340/384.6, 384.1, 340/384.4, 384.7, 384.72, 384.73, 388.1, 692; 381/107, 108, 150, 339, 340, 190; 331/155

(56) References Cited

U.S. PATENT DOCUMENTS

| | | | | |
|---|---|---|---|---|
| 3,681,916 A | | 8/1972 | Itoyama et al. | 368/245 |
| 3,815,129 A | * | 6/1974 | Sweany | 340/388.1 |
| 4,001,816 A | | 1/1977 | Yamada et al. | 340/384.1 |
| 4,096,473 A | | 6/1978 | Sweany et al. | 340/511 |
| 4,157,459 A | | 6/1979 | Bush et al. | 379/375.01 |
| 4,195,284 A | | 3/1980 | Hampshire et al. | 340/384.1 |
| 4,213,121 A | | 7/1980 | Learn et al. | 340/384.1 |
| 4,303,908 A | * | 12/1981 | Enemark et al. | 340/384.1 |
| 4,325,058 A | | 4/1982 | Wagner et al. | 340/562 |
| 4,352,169 A | | 9/1982 | Asano | 368/73 |
| 4,393,373 A | * | 7/1983 | Torri et al. | 340/384.1 |
| 4,558,305 A | | 12/1985 | Black et al. | 340/384.1 |
| 4,703,213 A | * | 10/1987 | Gasler | 310/316 |
| 4,803,459 A | | 2/1989 | Ta | 340/459 |
| 5,019,805 A | | 5/1991 | Curl et al. | 340/628 |
| 5,313,190 A | | 5/1994 | Clayton et al. | 340/436 |
| 5,398,024 A | * | 3/1995 | Knowles | 340/474 |
| 5,414,406 A | * | 5/1995 | Baxter | 340/388.1 |
| 5,420,570 A | | 5/1995 | Leitten et al. | 340/574 |
| 5,479,152 A | | 12/1995 | Walker et al. | 340/545 |
| 5,560,051 A | | 10/1996 | Butts | 4/479 |
| 5,675,311 A | | 10/1997 | Burnett et al. | 340/384.4 |
| 5,675,312 A | | 10/1997 | Burnett | 340/384.72 |
| 5,793,282 A | | 8/1998 | Arnold et al. | 340/384.6 |
| 5,872,506 A | * | 2/1999 | O'Brien et al. | 340/384.6 |
| 5,905,326 A | * | 5/1999 | Schnell | 310/318 |
| 4,697,932 A | | 11/1999 | Matievic | 368/255 |
| 5,990,784 A | * | 11/1999 | Burnett | 340/384.7 |
| 6,078,124 A | * | 6/2000 | Furuhashi et al. | 310/318 |
| 6,157,804 A | * | 12/2000 | Richmond et al. | 399/319 |

* cited by examiner

*Primary Examiner*—Toan Ngoc Pham
(74) *Attorney, Agent, or Firm*—Niro, Scavone, Haller & Niro

(57) ABSTRACT

A piezoelectric transducer driving circuit has a main oscillator stage, a buffer circuit, and a voltage-doubling circuit. The main oscillator stage includes a frequency-swept signal generator that can be configured to provide different outputs to the buffers, which in turn provide the output to the voltage-doubling circuit, which supplies the piezoelectric transducer, causing it to mechanically deform and produce audible sounds of different types.

18 Claims, 8 Drawing Sheets

PIEZOELECTRIC SIREN DRIVER CIRCUIT

BACKGROUND OF THE INVENTION

The present invention is directed toward an inexpensive and compact apparatus for providing a loud siren or whooping sound using a minimum of space and power, avoiding use of a bulky transformer, and employing a piezoelectric transducer, a frequency-swept signal generator, and an amplifier circuit.

A variety of products from automobiles to household appliances rely upon effective alarms to notify the user of a wide variety of conditions. Many of these devices employ piezoelectric transducers that generate sounds or tones that are continuous or pulsing. Alternative sounds, such as a siren sound or a "whooping" sound are desirable because they may be more audibly distinctive. However, currently available alarms that make such sounds are large and expensive, because they use power transistors to power a transformer which then drives a piezoelectric element. Thus, a simple, inexpensive and compact alarm that does not use a transformer is desired.

The sound output of the invention is amplified by using a logic circuit consisting of a buffered voltage doubling circuit. A logic circuit is a electrical circuit that performs symbolic logic or Boolean algebraic operations. Piezoelectric transducers are sound-producing electronic devices that are preferred by industry because they are by and large extremely inexpensive, reliable, durable, and versatile. This transducer has the unique property that it undergoes a reversible mechanical deformation on the application of an electrical potential across it. Conversely, it also generates an electrical potential upon mechanical deformation. These characteristics make it highly desirable for sound-producing applications. When an oscillating potential is placed across the transducer, it vibrates at roughly the same frequency as the oscillations. These vibrations are transmitted to the ambient medium, such as air, to become sound waves. Piezoelectric transducers can also be coupled to a simple circuit in what is known as a feedback mode, well known in the art, in which there is an additional feedback terminal located on the element. In this mode, the crystal will oscillate at a natural, resonant frequency without the need for an external source for applying continuous driving oscillations. As long as the oscillations are in the range of audible sound, i.e., 20 to 20,000 Hertz, such oscillations can produce an audible signal for use as an alarm or an indicator.

Any periodic oscillation can be characterized by at least one amplitude and frequency Ordinarily, the amplitude of oscillations of interest in a piezoelectric transducer application will be dictated by the voltage swing applied across the element. By the principles explained above, it is evident that there will be a greater mechanical deformation in the crystal with greater applied voltage. The effect is roughly linear within limits, the limits being based in general on crystal composition and geometry. Thus, in the linear region, doubling the voltage swing doubles the mechanical deformation. Doubling the mechanical deformation significantly increases the amplitude of vibrations transmitted into the ambient medium. Increased amplitude of vibrations in the medium causes an increased sound level, a relationship determinable by well known physical equations.

More specifically, when a piezoelectric element possesses two terminals and a driving oscillation is placed across one while the other is clamped to a common potential such as ground, the voltage swing will be at most the amplitude of the oscillations. Thus, if an oscillation of amplitude of 5 volts is placed across one terminal, while the other is maintained at 0 volts, the maximum voltage swing will be 5 volts. This effectively caps the achievable decibel level of any sound to a value corresponding to the supply voltage. One could double the supply voltage to achieve double the voltage swing, but this has the disadvantage of added cost, and further is impractical when a piezoelectric audio circuit is to be placed in a unit having a standardized voltage supply such as an automobile. Alternatively, one could use a second supply disposed to provide the same oscillations but in a reversed polarity to double the effective voltage swing. But this approach possesses at least the same disadvantages.

SUMMARY OF THE INVENTION

The present invention therefore employs the buffered voltage doubling circuitry shown in U.S. Pat. No. 5,990,784, "Schmitt Trigger Loud Alarm with Feedback." That patent is owned by the assignee of this application, and its contents are adopted by reference here.

As is shown in the '784 patent, when a piezoelectric element possesses two terminals and a driving oscillation is placed across one, and the identical driving oscillation is placed across the other but shifted 180 degrees out of phase, the voltage swing will be about two times the amplitude of the oscillations. By "180 degrees out of phase" it is meant that each terminal generates a signal having a substantially square wave form, wherein one wave form is high and the other is low at any given time. Thus, if an oscillation having an amplitude of 5 volts is placed across one terminal while the other experiences the same oscillation but separated by 180 degrees of phase (half the period of the cycle), then the maximum voltage swing will be 10 volts. Higher sound pressures and louder tones result with a voltage swing of 10 volts than with a voltage swing of 5 volts.

The phase shift needed to effectively double the voltage swing across the transducer can be accomplished by use of one or more Schmitt triggers. It is believed that Schmitt triggers are particularly useful to the present invention because of their fast switching time and because they require minimal addition of components. Schmitt triggers are a special type of bistable amplifier circuit known in the art which can sustain two different voltages, each being equal in amplitude but 180 degrees out of phase. Schmitt triggers further have regenerative capability through the use of a feedback loop. In other words, a Schmitt trigger can be started or triggered by an initial pulse of only a short duration and can be maintained indefinitely (for all practical purposes) in one of its bistable states through its own feedback, without the need for an external source to supply continuing driving oscillations. Furthermore, Schmitt triggers have the added benefit of producing either a high or low output in response to a trigger signal, depending upon the state that the circuit is already in. In other words, where the input voltage is between the low and high threshold voltages of each of the stable states of a Schmitt trigger, the output of the Schmitt trigger is inverted from high to low, or vice versa. This feature can be used to place alternating voltage drops of equal magnitude across opposing terminals of a transducer, thus increasing the mechanical deformation in the transducer.

Particularly in alarm applications, what is needed is a loud sound that does not depend on the added circuit complexity of a doubled supply voltage or an additional reversed polarity supply. Loud sounds require relatively high voltages to produce relatively large amplitude vibrations in the transducer. In a special analog circuit, this might not be an obstacle. However, in a circuit containing elements that are safely and reliably operable only in a limited range of potentials, accommodations must be made to insure that those elements do not receive an electrical potential that is too high. Thus, in particular when a loud alarm sound is needed, care must be taken to separate the potentials driving the transducer from the potentials driving the more sensitive circuit elements. For example, integrated circuits often have specifications limiting the recommended power supply to 5 volts DC. If one desires to power a transducer using a substantially higher supply voltage, care must be taken to regulate the power supplied to the integrated circuit.

The voltage doubling circuit described here is used in conjunction with a frequency-swept signal generator, such as an integrated circuit like the ZSD100 made by Zetex Inc., 87 Modular Avenue, Commack, N.Y., 11725. A frequency-swept signal generator is a device that generates a signal that has an initial target frequency and a final target frequency. The frequency of the generated signal varies between the initial and final target frequencies over a target period of time. The initial frequency, final frequency, and target time are determined by inputs into the device. The signal generator can be comprised of discrete components, or can be an integrated circuit. An example of the use of discrete components is shown in U.S. Pat. No. 5,675,311. That patent is owned by the assignee of this application, and its contents are adopted by reference here.

Instead of using the signal generator with a power transistor and a transformer, the voltage doubling circuit is used. The signal generator produces an output which varies in frequency. That output is fed into the voltage doubling circuit. The voltage doubling circuit buffers the signal generating circuit from the piezoelectric transducer, and doubles the voltage driving the transducer, thus increasing the audible output of the transducer. By varying the value of external components connected to the signal generating circuit, a variety of sounds can be produced.

Accordingly, an object of the present invention is inexpensively to enable loud sounds of a siren-like or whooping character to be generated by an audio circuit that is compact and inexpensive.

DETAILED DESCRIPTION OF THE PREFERRED EMBODIMENT

Figure 1:
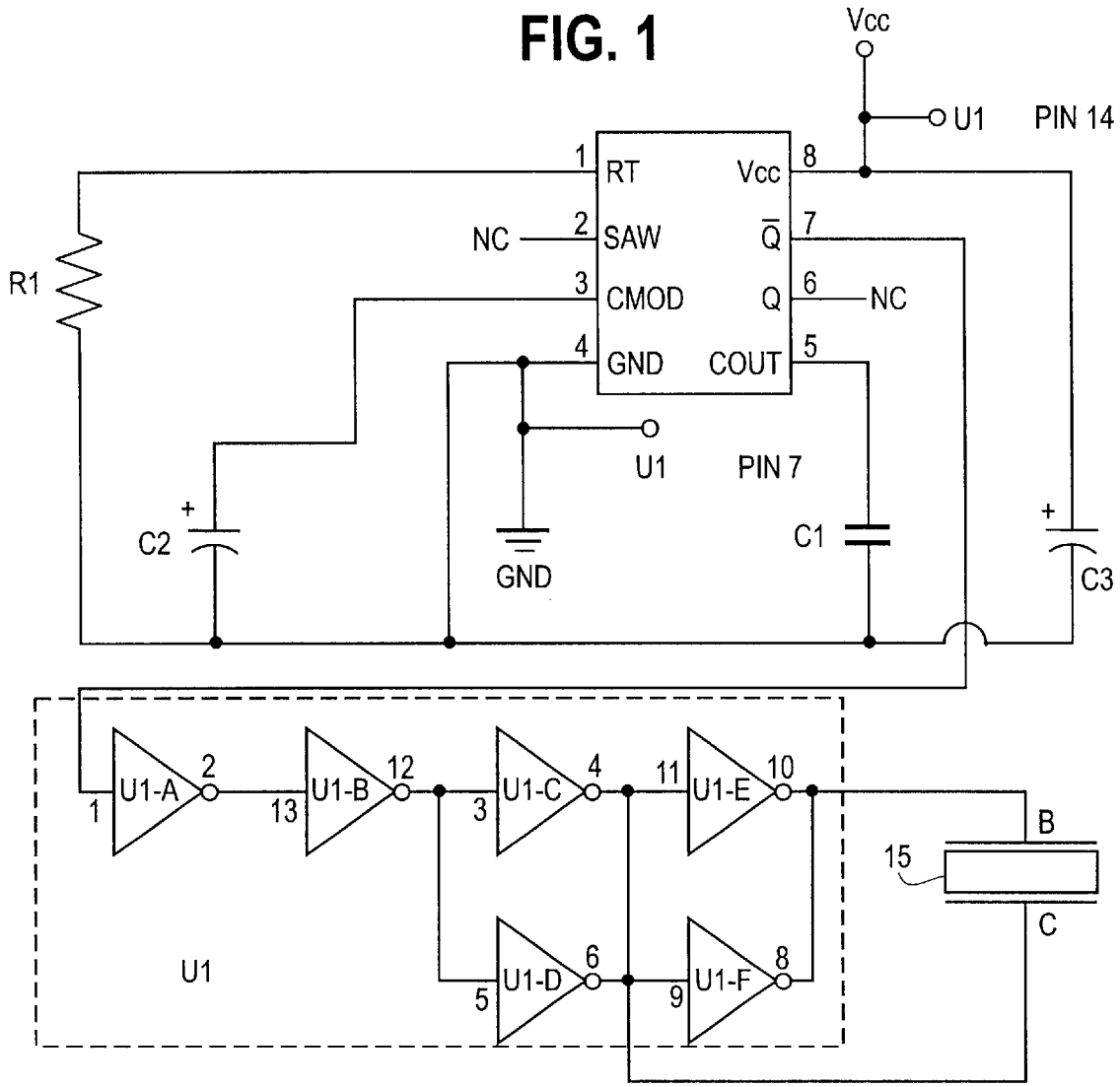
FIG. 1 is a schematic showing the siren sound configuration of the invention. Pins 7 and 14 on U2 have been omitted for clarity because their functions are well understood.
Figure 2:
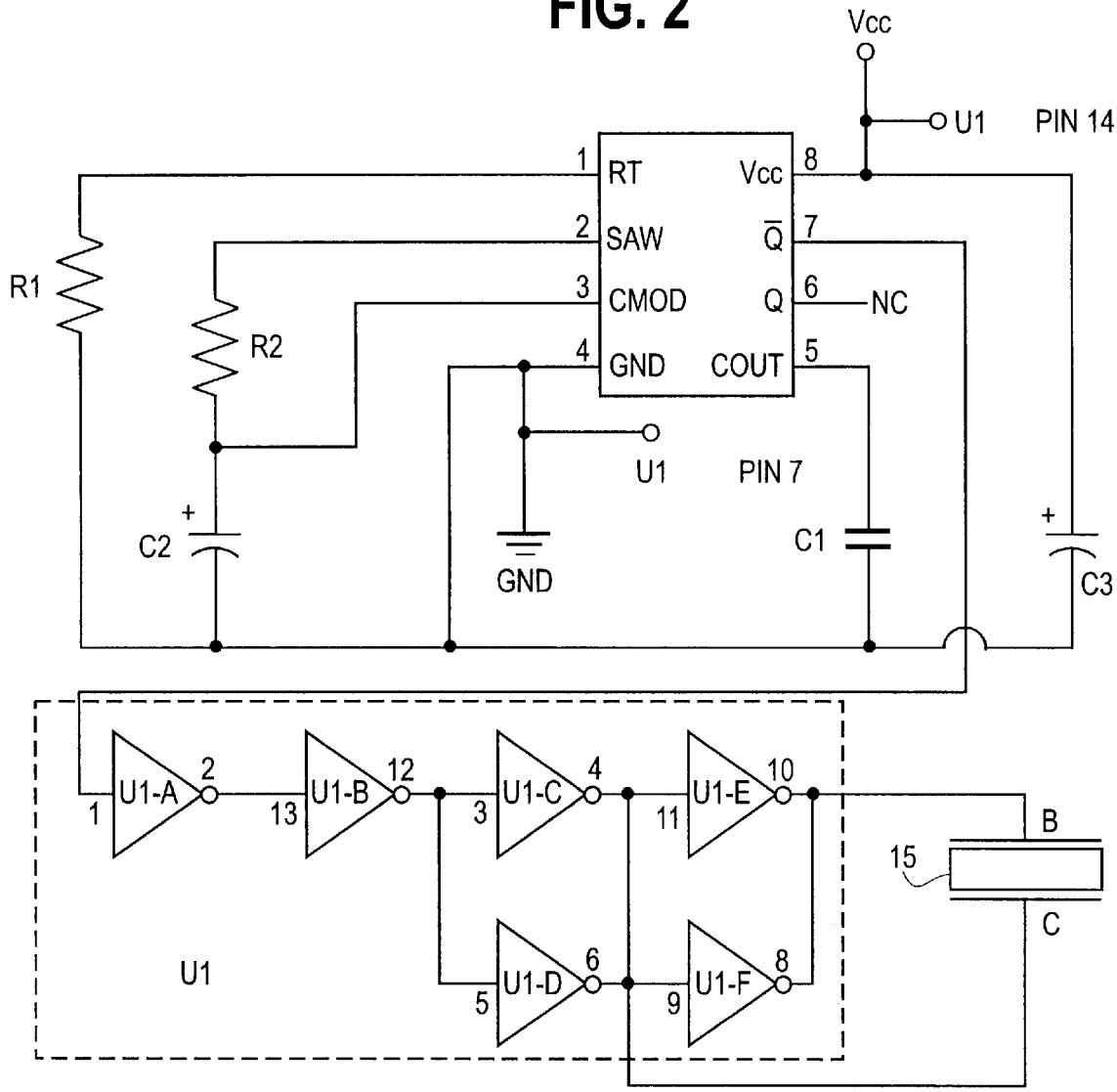
FIG. 2 is an schematic showing the whooping sound configuration of the invention.
Figure 11:
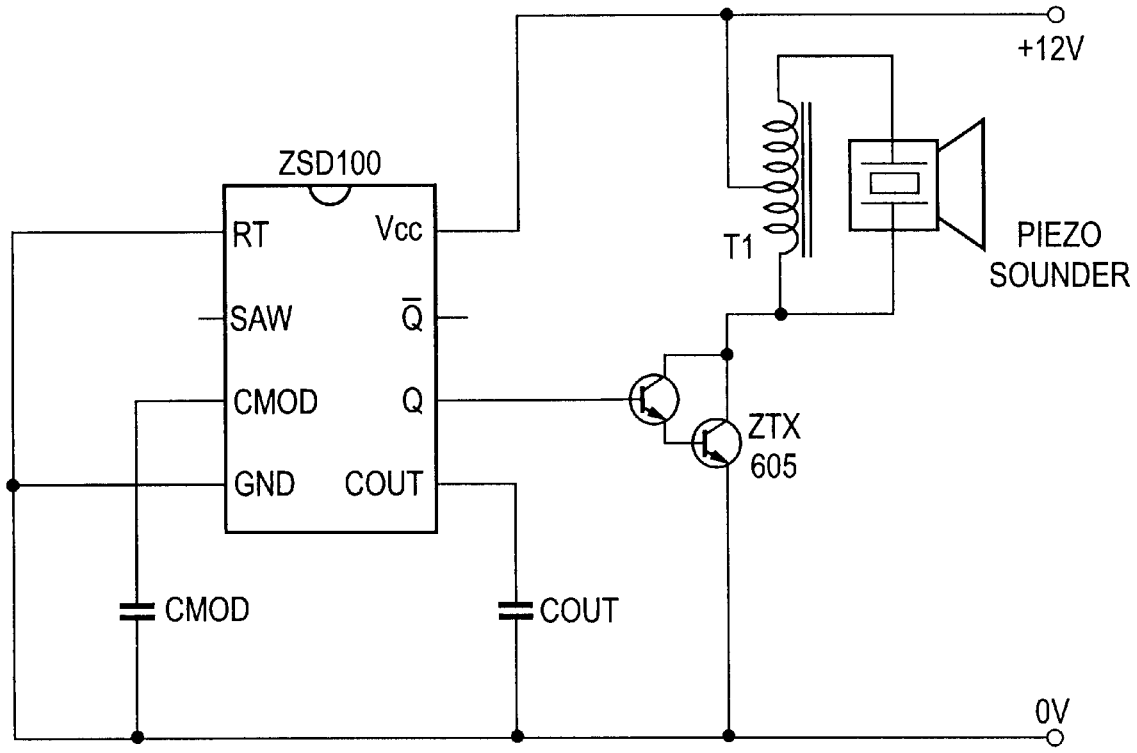
FIG. 11 depicts the ZSD100 integrated circuit manufactured by Zetex.

The piezoelectric siren driver circuit of FIG. 1 or 2 uses a frequency swept signal generator integrated circuit U2, such as the ZSD100 provided by Zetex Inc. 87 Modular Avenue, Commack, N.Y. 11725, to produce varying output waveforms. As shown in FIG. 11, the manufacturer of the ZSD100 shows a traditional means for driving a piezo sounder. As the manufacturer indicates, the the ZSD100 uses a large power transistor, the ZTX605, to power a transformer T1 which then drives a piezo sounder.

There are several problems with using a transformer or other inductive components to drive a piezoelectric transducer. A transformer requires a large amount of space, demands large amounts of electrical power, produces electromechanical noise into surrounding components, and is quite expensive. The invention is circuitry that drives a piezoelectric transducer from a device, such as the ZSD100, with a circuit that is cost effective, small in size, avoids a transformer, and which does not produce electromechanical noise.

The ZSD100 signal generator U2 in FIGS. 1 and 2 produces a varying output frequency at pin 7, $Q_{NOT}$, of U2. The varying output frequency is then fed into a buffered voltage doubling circuit U1 shown in FIGS. 1 and 2. One version of the voltage doubling circuit is a modified version of the circuit shown in U.S. Pat. No. 5,990,784, "Schmitt Trigger Loud Alarm With Feedback." The voltage doubling circuit U1 serves two purposes. It buffers the signal generator IC U2 from the piezoelectric transducer 15. The voltage doubling circuit U1 is also a voltage doubler or amplifier for the piezoelectric transducer 15. Voltage doubling increases the sound output level of the piezoelectric transducer.

By changing the values of various external components that connect to the signal generator U2, different output sounds can be achieved. Two of these unique sounds are the "siren" and "whooping" sounds. FIG. 1 shows a configuration for a siren tone. FIG. 2 shows a configuration for a whooping tone. The main difference between the siren and the whooping sound is that the "SAW" pin (pin 2) and the "$C_{MOD}$" pin (pin 3) of U2 are not connected in FIG. 1, but are connected through resistor R2 in FIG. 2, the configuration that produces the whooping sound.

Component values and identifications for a preferred embodiment of the circuits of FIGS. 1 and 2 are as follows:

| External Component | Value | Value and Function |
|---|---|---|
| R1 | 300 KOhm | Frequency controlling resistor in FIGS. 1 and 2. |
| R2 | 0 Ohm | Shorts the SAW and CMOD connections together in FIG. 2. |

-continued

| External Component | Value | Value and Function |
|---|---|---|
| C1 | 1000 pF | Programs the output oscillator frequency in FIGS. 1 and 2. |
| C2 | 2.2 nF | Programs the low frequency modulation oscillator in FIGS. 1 and 2. |
| C3 | 2.2 nF | Filter capacitor. |
| | U1, Voltage Doubling Circuit in FIGS. 1 and 2: | |
| U1 | 1, 3, 5, 9, 11, 13 | Inverter inputs. |
| U1 | 2, 4, 6, 8, 10, 12 | Inverter outputs. |
| U1 | 7 | IC ground. |
| U1 | 14 | IC power source. |
| | U2, ZSD 100 Siren Integrated Circuit in FIGS. 1 and 2: | |
| U2 | Pin 1 ($R_T$) | External resistor to improve both the modulating and output frequency oscillators. |
| U2 | Pin 2 (SAW) | Used to produce the whooping sound, only in FIG. 2. |
| U2 | Pin 3 ($C_{MOD}$) | External capacitor to set the low frequency modulating oscillator. |
| U2 | Pin 4 (GND) | Ground connection. |
| U2 | Pin 5 ($C_{OUT}$) | External capacitor used to program the output oscillator frequency. |
| U2 | Pin 6 (Q) | Non-inverted output, not used in either circuit. |
| U2 | Pin 7 ($Q_{NOT}$) | The inverted output driver. This pin connects to the Schmitt Trigger IC U1 in both circuits. |
| U2 | Pin 8 ($V_{CC}$) | Main power source. |

The operation of the piezoelectric siren driver circuit will now be described in more detail, with respect to siren operation first. The siren circuit shown in FIG. 1 will be divided into three separate parts to describe how it functions.

Figure 3:
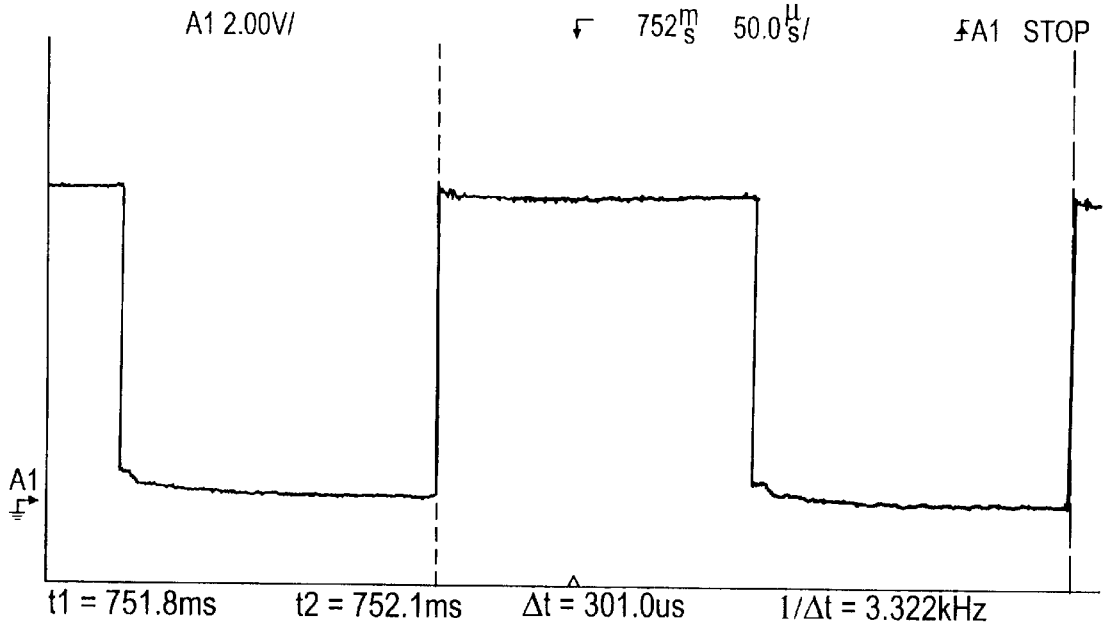
FIG. 3 is a graph depicting a square wave at a frequency measured at one point in time at pin 7 of U2, the siren signal generating integrated circuit.
Figure 4:
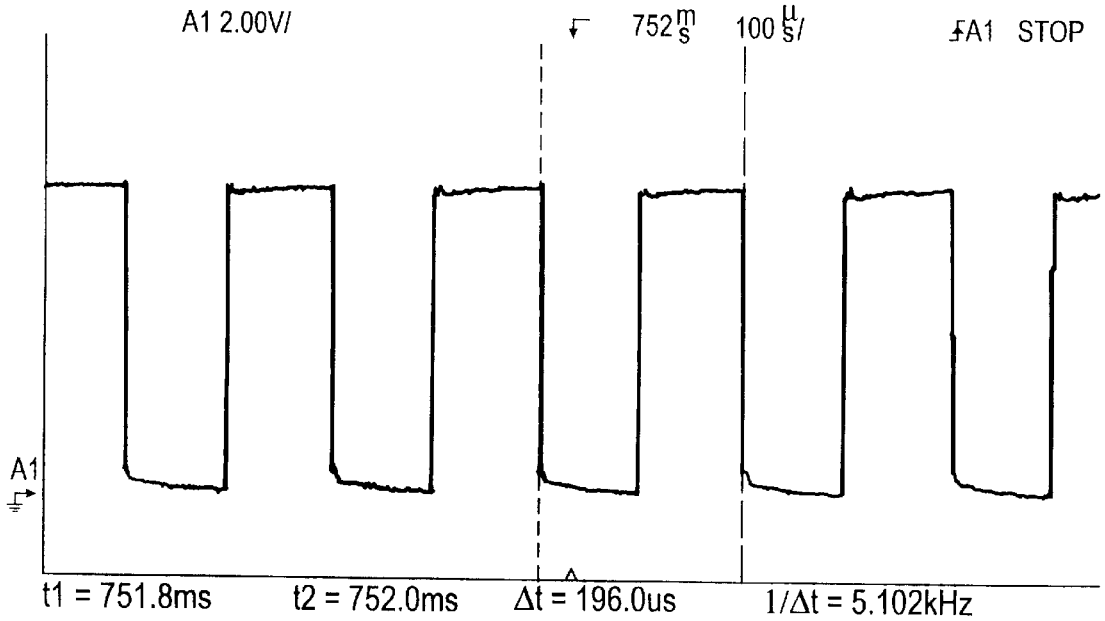
FIG. 4 is a graph depicting a square wave at a different frequency measured at a point in time different from than that shown in FIG. 3, measured at pin 7 of U2, the signal generating integrated circuit.
Figure 5:
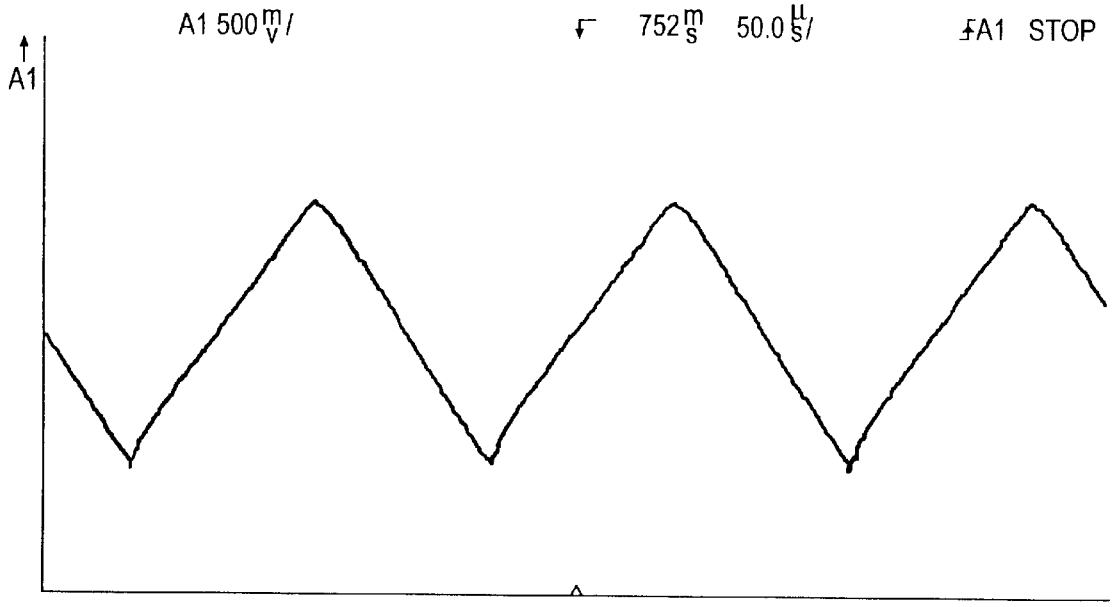
FIG. 5 is a graph of the ramping of the frequency at pin 7 of U2 from the lower to the higher value, and back to the lower value, that is, the siren configuration.

The first part is the main oscillator stage, which is comprised of U2 and the external components R1, C1, C2, and C3. The main oscillator stage provides a square wave output on pin 7 ($Q_{NOT}$) of U2. This square wave output is constantly changing its frequency. FIGS. 3 and 4 show the changing frequency at two different times or instants of the sequence. The changing frequency is a two-step process. First the square wave is ramped from a low frequency up to high frequency. The values of both the lower and upper frequencies are determined by the external components R1, C1, C2 and C3 that are connected to U2. The square wave is then ramped from the high frequency established in step one down to the low frequency that was established-in step one. These two steps are then repeated over and over as long as power is supplied to the circuit. FIG. 5 shows a graphical representation of the ramping sequence that produces a siren sound from piezoelectric transducer 15.

Figure 6:
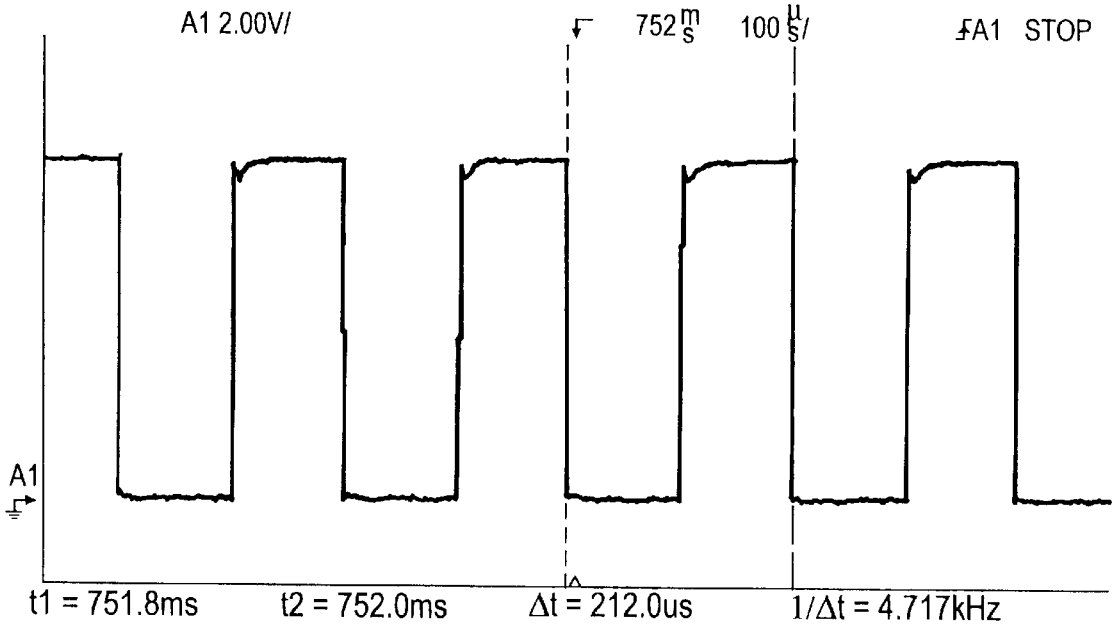
FIG. 6 depicts the output at pin 2 of U1-A in the voltage doubling circuit U1 in FIGS. 1 and 2 at one point in time.
Figure 7:
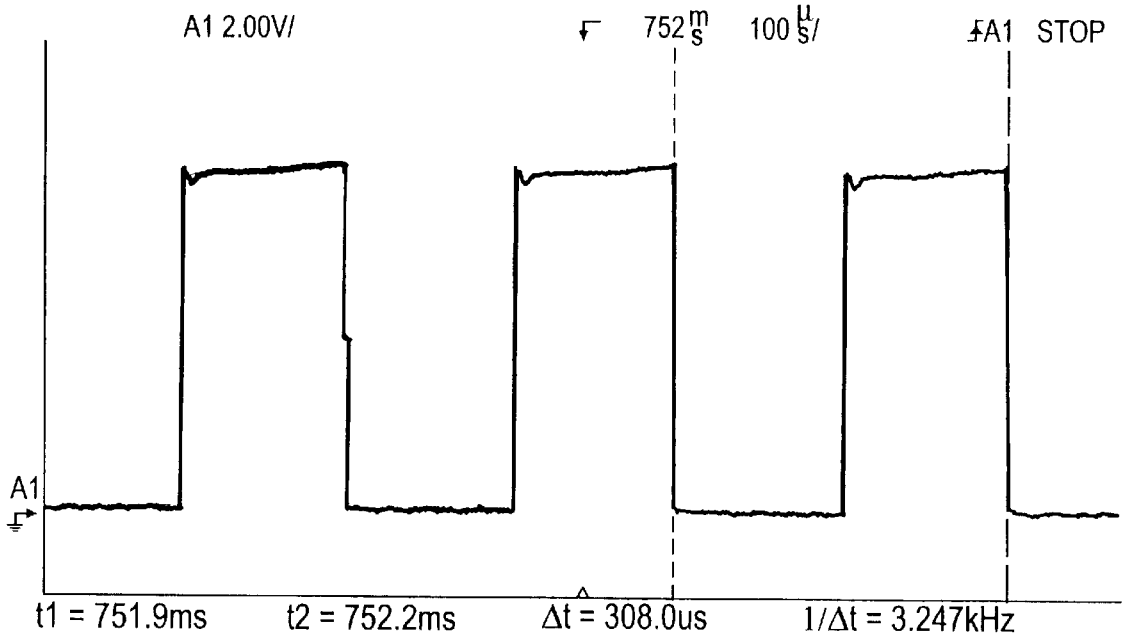
FIG. 7 depicts the output at pin 2 of U 1-A in the voltage doubling circuit U 1 in FIGS. 1 and 2 at a point in time different from that shown in FIG. 6.

The square wave from pin 7 ($Q_{NOT}$) of U2 is fed into two separate buffer drivers, U1-A and U1-B in doubling circuit U1. These buffers U1-A and U1-B reside within U1 and isolate U2 from the remainder of doubling circuit U1. The output from buffers U1-A and U1-B mimics the changing square wave frequency that comes from pin 7 ($Q_{NOT}$) of U2. FIGS. 6 and 7 show the output from the first buffer U1-A at two different times within the sequence.

Figure 8:
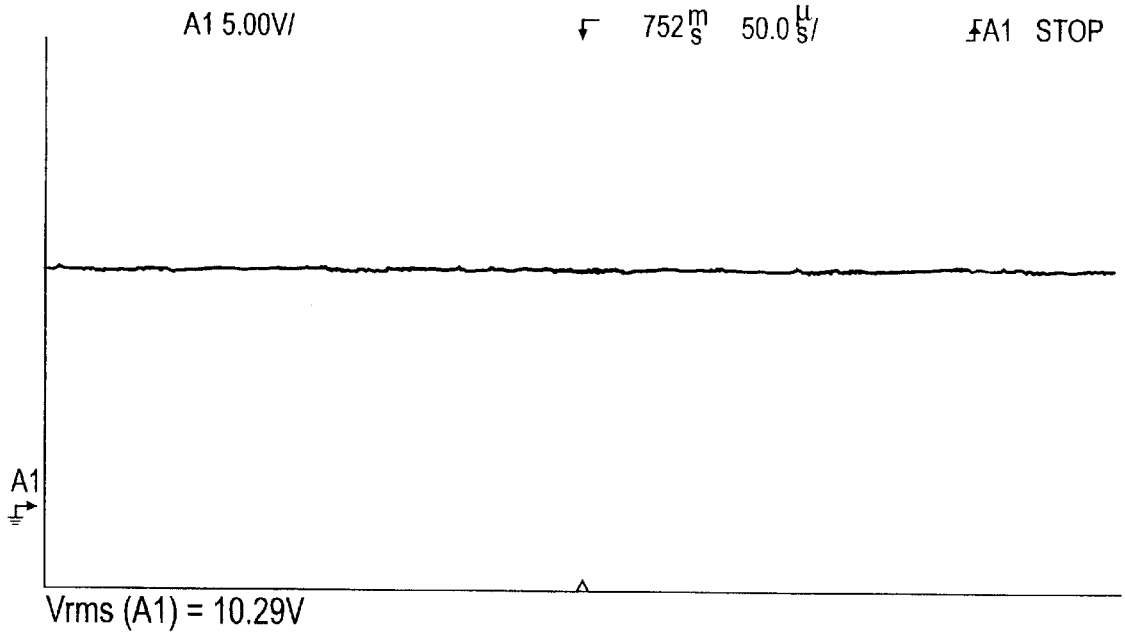
FIG. 8 shows the incoming voltage, $V_{cc}$, at pin 14 of U1 and pin 8 of U2 in FIGS. 1 and 2.
Figure 9:
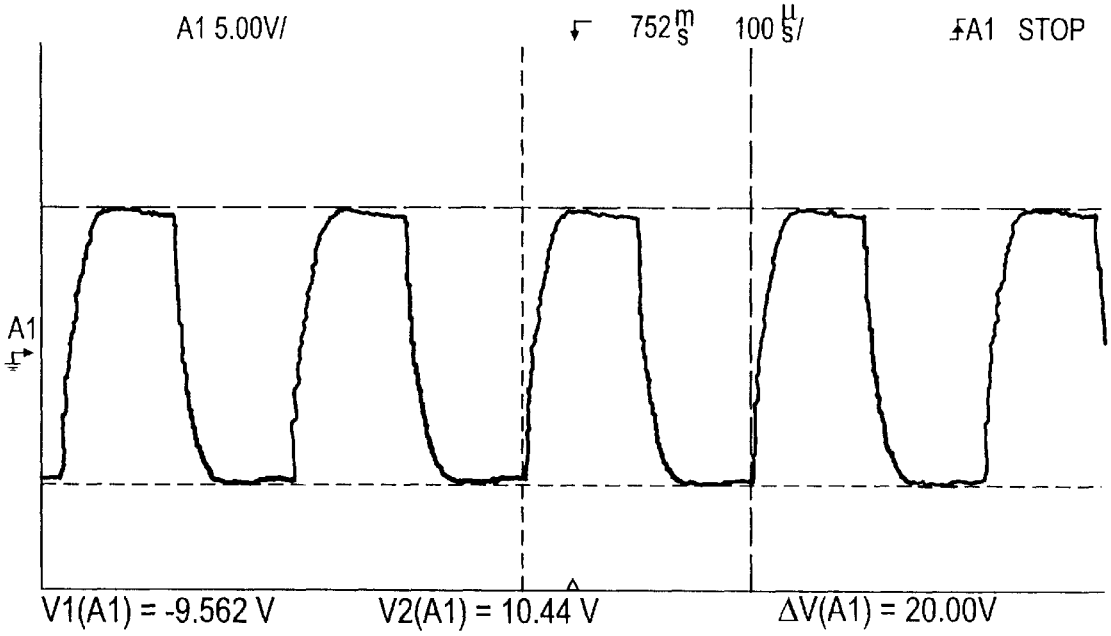
FIG. 9 shows the doubled potential difference as seen by the piezoelectric transducer, between pins 6 and 8 in FIGS. 1 and 2.
Figure 9:
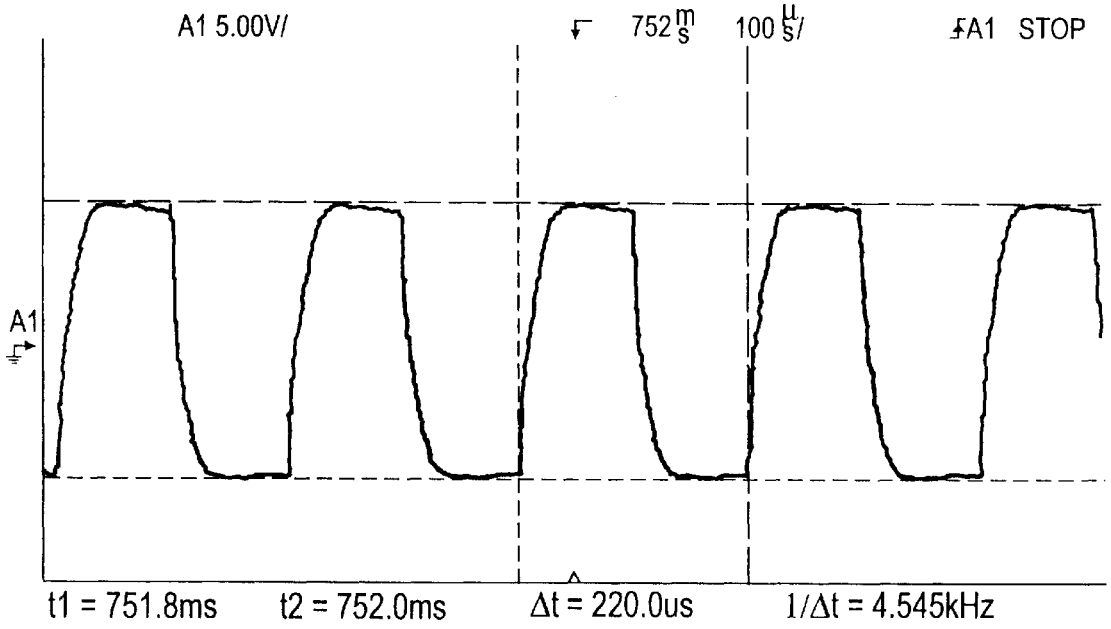

Another stage is the piezoelectric transducer interface, which is comprised of the remainder of doubling circuit U1, that is, U1-C, U1-D, U1-E and U1-F which together double the voltage provided to the transducer 15. The operation of this circuit is described in U.S. Pat. No. 5,990,784, "Schmitt Trigger Loud Alarm With Feedback." A voltage doubling circuit works by providing a voltage to the piezoelectric transducer that is twice the amplitude of the supply voltage to the doubling circuit. FIG. 8 shows a steady incoming voltage of 10 VDC ($V_{cc}$) at pin 14 of U1. FIG. 9 shows how the voltage doubling circuit converts the 10 VDC incoming voltage into a pulsating square wave that is twice the amplitude of the input voltage, measured between pins 6 and 8 of U1. U1-C and U1-D, and U1-E and U1-F, are arranged in parallel in order to provide sufficient current to piezoelectric transducer 15. The output of U1-C and U1-D is supplied to one side of piezoelectric transducer 15. The output of U1-E and U1-F, which is 180 degrees out of phase with the output of U1-C and U1-D, is fed to the other side of transducer 15. As a result, the voltage swing across the transducer 15 is about double the amplitude of the signal generated by one set of parallel inverters, that is, U1-C and U1-D, or U1-E and U1-F.

Figure 10:
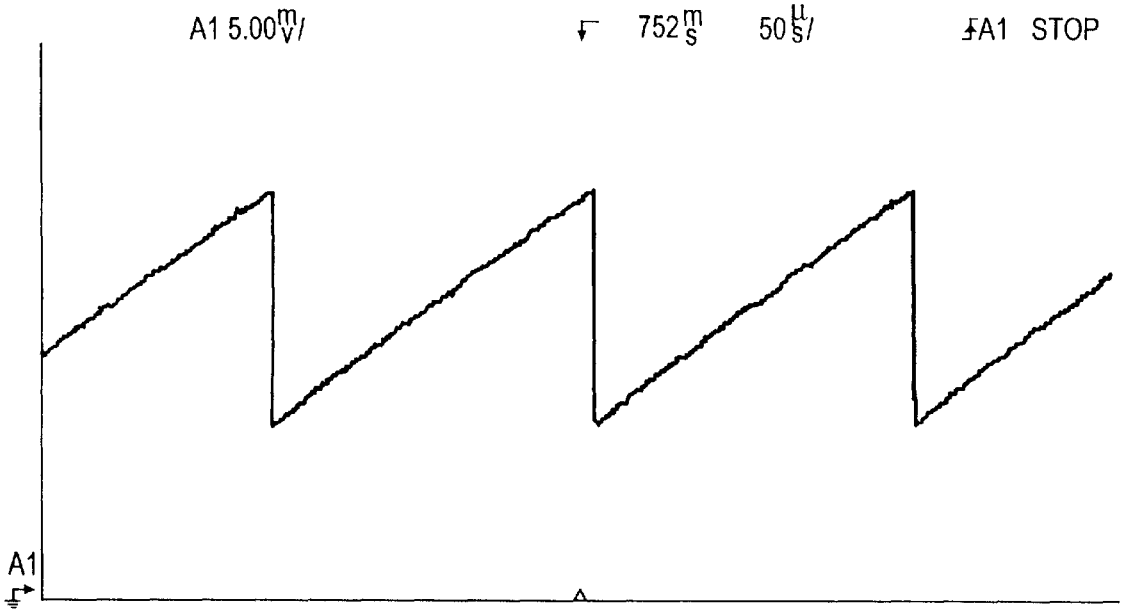
FIG. 10 depicts the ramping of frequency from low to high at pin 7 of U2 in the whooping configuration.

The whooping configuration will now be described. As before, U2 and its external components R1, R2, C1, C2, and C3 provides a square wave output on pin 7 ($Q_{NOT}$) of U2, as shown in FIGS. 3 and 4. The values of both the lower and upper frequencies are determined by the external components that are connected to U2, e.g., R1, R2, C1, C2, and C3 or their equivalents; some exemplary alternatives are described below. This step is where the two configurations differ, because R2 shorts the SAW and CMOD pins (pins 2 and 3) in FIG. 2. U2 abruptly switches back to the lower frequency that was established in step one, at which point the process start all over again. These two steps are then repeated over and over as long as power is supplied to the circuit. FIG. 10 shows a graphical representation of what the sequence looks like. Contrast this Figure with FIG. 5, which shows the sound resulting from the siren configuration. The operation of the remainder of the circuitry is the same as that described for the siren configuration in FIG. 1.

There are several alternative configurations for the circuitry. First, the external components that control U2 are hard-wired into the circuit, but external devices can be added to permit external controlling. An example would be an external potentiometer that allows a person to vary the resistance of R1, thereby changing the oscillator frequency. As the oscillator frequency is changed the output sound reflects those changes. This modification would allow for countless sound outputs, which could be identified as unique sounds for each variation.

Second, R1 could be removed from the circuit and replaced with a transistor switch or various logic circuits. In this manner "$R_T$" from the ZSD100 acts as a power-down switch. When the switch is open the circuit is disabled, and when the switch is shorted the circuit is enabled.

Third, R1 could be replaced with a digital potentiometer controlled by a computer through an interface linked to various sensors. As the various sensors acknowledge activity the computer would then change the value of R1, thereby changing the output sound for the different sensor conditions.

Fourth, R2 in FIG. 2 could be replaced with an external switch that could be controlled manually or via a computer. In this configuration an operator would have the possibility of producing both the siren and whooping sounds within a single package.

Of course, it should be noted that various changes and modifications to the preferred embodiments of this invention will be apparent to those skilled in the art; such changes and modifications can be made without departing from the spirit and scope of the present invention. For instance, other audio transducers could be employed besides a piezoelectric transducer. Also, other inverters could be used, such as NAND gates. Discrete components could be used in place of integrated circuits. It is, therefore, intended that such changes and modifications be covered by the following claims.

What is claimed is:

1. A circuit for generating electrical oscillations in the audible frequency range comprising:

a frequency-swept signal generator, said generator selectively providing an output voltage varying in frequency;

a logic circuit operatively connected to the output of the frequency-swept signal generator; and a piezoelectric transducer operatively connected to the output of the logic circuit, said transducer mechanically deforming in response to a signal from the logic circuit so as to produce audible oscillations thereby.

2. The circuit of claim 1 wherein the frequency-swept signal generator is a ZSD100 integrated circuit.

3. The circuit of claim 1 wherein the logic circuit is a buffered voltage-doubling circuit.

4. The circuit of claim 3 wherein the voltage-doubling circuit includes at least one inverter.

5. The circuit of claim 4 wherein the at least one inverter is a Schmitt trigger.

6. The circuit of claim 3 wherein the voltage-doubling circuit includes at least two inverters connected in series.

7. The circuit of claim 6, where the series-connected inverters are Schmitt triggers.

8. The circuit of claim 1 wherein the logic circuit is a buffered voltage-doubling circuit.

9. A piezoelectric driver circuit comprising:

a frequency-swept signal generator providing an output varying in frequency;

a logic circuit connected to and receiving the output of the frequency-swept signal generator; and a piezoelectric transducer connected to the output of the logic circuit, and mechanically deforming in response to the output of the logic circuit.

10. The driver circuit of claim 9, wherein the logic circuit is a voltage-doubling circuit.

11. An electrical circuit for generating audible frequency oscillations comprising:

a main oscillator stage including a frequency-swept signal generator in a circuit having resistive and capacitative elements configurable to produce at least two distinct frequency-varying outputs;

a buffer circuit connected to and receiving the output from the main oscillator stage;

a voltage-doubling circuit connected to and receiving the output of the buffer circuit;

a piezoelectric transducer connected to and receiving the output of the voltage-doubling circuit;

the buffer circuit isolating the main oscillator stage from the voltage-doubling circuit.

12. The circuit of claim 11 wherein the frequency-swept signal generator is a ZSD100 integrated circuit.

13. The circuit of claim 11 wherein the buffer circuit includes at least one inverter.

14. The circuit of claim 13 wherein the at least one inverter is a Schmitt trigger.

15. The circuit of claim 11 wherein the voltage-doubling circuit includes at least one inverter.

16. The circuit of claim 11 wherein the voltage-doubling circuit includes at least two inverters connected in series.

17. The circuit of claim 16 where the series-connected inverters are Schmitt triggers.

18. A circuit for generating electrical oscillations in the audible frequency range comprising:

means for providing a selectably variable-frequency voltage;

a logic circuit operatively connected to the means for providing a selectably variable-frequency voltage; and a piezoelectric transducer operatively connected to the output of the logic circuit, said transducer mechanically deforming in response to a signal from the logic circuit so as to produce audible oscillation thereby.

* * * * *